US005329302A

United States Patent [19]

Fogle et al.

[11] Patent Number: 5,329,302

[45] Date of Patent: Jul. 12, 1994

[54] TAPERED PLATEN ROLLER FOR THERMAL PRINTER

[75] Inventors: Ronald L. Fogle, Springboro; Larry D. Strausburg, Waynesville, both of Ohio

[73] Assignee: Pitney Bowes Inc., Stamford, Conn.

[21] Appl. No.: 950,361

[22] Filed: Nov. 6, 1992

[51] Int. Cl.[5] ..... B41J 11/04

[52] U.S. Cl. ..... 346/136; 400/648; 400/661.3

[58] Field of Search ..... 346/136; 400/648, 654, 400/656, 659, 658, 661.3, 662

[56] References Cited

U.S. PATENT DOCUMENTS

| | | | |
|---|---|---|---|
| 3,929,327 | 12/1975 | Olson | 271/250 |
| 4,496,257 | 1/1985 | Habelt et al. | 400/578 |
| 4,728,967 | 3/1988 | Tomita et al. | 346/136 |
| 4,750,422 | 6/1988 | Gysin | 101/426 |
| 4,938,129 | 7/1990 | Miciukiewicz et al. | 101/76 |

*Primary Examiner*—Benjamin R. Fuller
*Assistant Examiner*—Huan Tran
*Attorney, Agent, or Firm*—Charles G. Parks, Jr.; Melvin J. Scolnick

[57] ABSTRACT

An improved platen roller is particularly suited for a thermal printing postage meter. The postage meter includes a registration wall, a print deck, a thermal print head mounted to the registration wall and extending over the deck to define a print station, a platen roller support assembly for supporting the platen roller parallel to the thermal print head and causing the platen roller to bias an envelope against the thermal print head and causing the envelope to traverse the thermal print head during a print cycle of the thermal postage meter. The platen roller is unitary in material construction of cellular urethane. The platen roller has a first and second end section, each section having a conical configuration a surface taper angle of between −2.0° degrees and −3.0° degrees.

8 Claims, 4 Drawing Sheets

TAPERED PLATEN ROLLER FOR THERMAL PRINTER

BACKGROUND OF THE INVENTION

The present invention relates to a thermal printer and, more particular, to a platen roller for a thermal printer.

It is an object of a conventional printing press type postage meter to print a postage indicia on a present envelope characterized by producing a postage indicia of consistent print contrast across the printed indicia. Additionally, it is an objective of a conventional printing press type postage meter to obtain this print quality in the specified printing area for envelopes varying paper grades (i.e., smoothness), porosity and envelope contour in the printing area.

Of particular note is the effect of the envelope contour in the printing area on print quality. It is a requirement, for example, by the United States Postal Service, that the postage indicia be printed in the upper right corner of the envelope. The contents of a particular envelope can cause this area to assume a variety of contour characteristic due in large part to the thickness of the contents and the particular shape of the contents.

Conventional thermal printers have required a relatively flat surface in the print area in order to insure adequate print quality. Hence, the difficulty in applying thermal printing techniques to postage metering mailing machines and like applications.

SUMMARY OF THE PRESENT INVENTION

It is an object of the present invention to present a platen roller particularly suited for thermal postage printing applications whereby the platen roller is particularly configured to compensate for variation in the contour of an envelope in the print area to produce a relative flat print surface.

The thermal postage meter is comprised of a number of modules or systems. Upon the placement of an envelope on the deck of the thermal printer by an operator, the envelope encounters a position sensing assembly which includes an envelope stop arrangement. The print sequence cycle is initiated by the microcontroller. Upon initiation of the print sequence, a platen roller assembly is positioned to bring the print area of the envelope into contact with the print ribbon of a ribbon cassette. A thermal print head of the postage meter is positioned as a backing to the print ribbon. The microcontroller drives a motor which in turn drives the platen roller. Rotation of the platen roller causes the envelope and cassette print ribbon to simultaneously traverse the print head while concurrently enabling the thermal print head. The platen roller is constructed from a cellular urethane and geometrically configured to apply varying biasing force across the print region of the envelope in response to variations in the edge contour of the envelope in the print area.

The platen roller has a length 2L and a radius of "R" at the center. The radius of the platen roller has a center directed taper at each end of approximately 3° with respective end radius of "R+h". In the preferred embodiment of the present invention, the platen roller is comprised of a 25 to 35 durometer unitary cellular urethane. Alternatively, the platen roller may be sectioned into individual sections 0.010 inch slits set at 0.070 inches apart with the same degree of taper.

The tapered platen roller functions by providing additional pressure at the larger roller diameter to provide additional force at envelope edge region against the print head. This is accomplished since the roller is compressed under load to approximate a constant surface along its length. The alternative split roller functions in like manner to the cellular roller in that the slits separate the roller into small sections that spring back in localized areas to force the envelope upward against the printhead for improved printing. The tapered cellular urethane roller is less likely to cause marking of the envelope and skewing problems than a solid urethane roller because of it's ability to compress in the direction of feed as well as the direction of loading and also negates some of the velocity differential along the length of the tapered roller.

DETAILED DESCRIPTION OF THE PREFERRED EMBODIMENT

Figure 1:
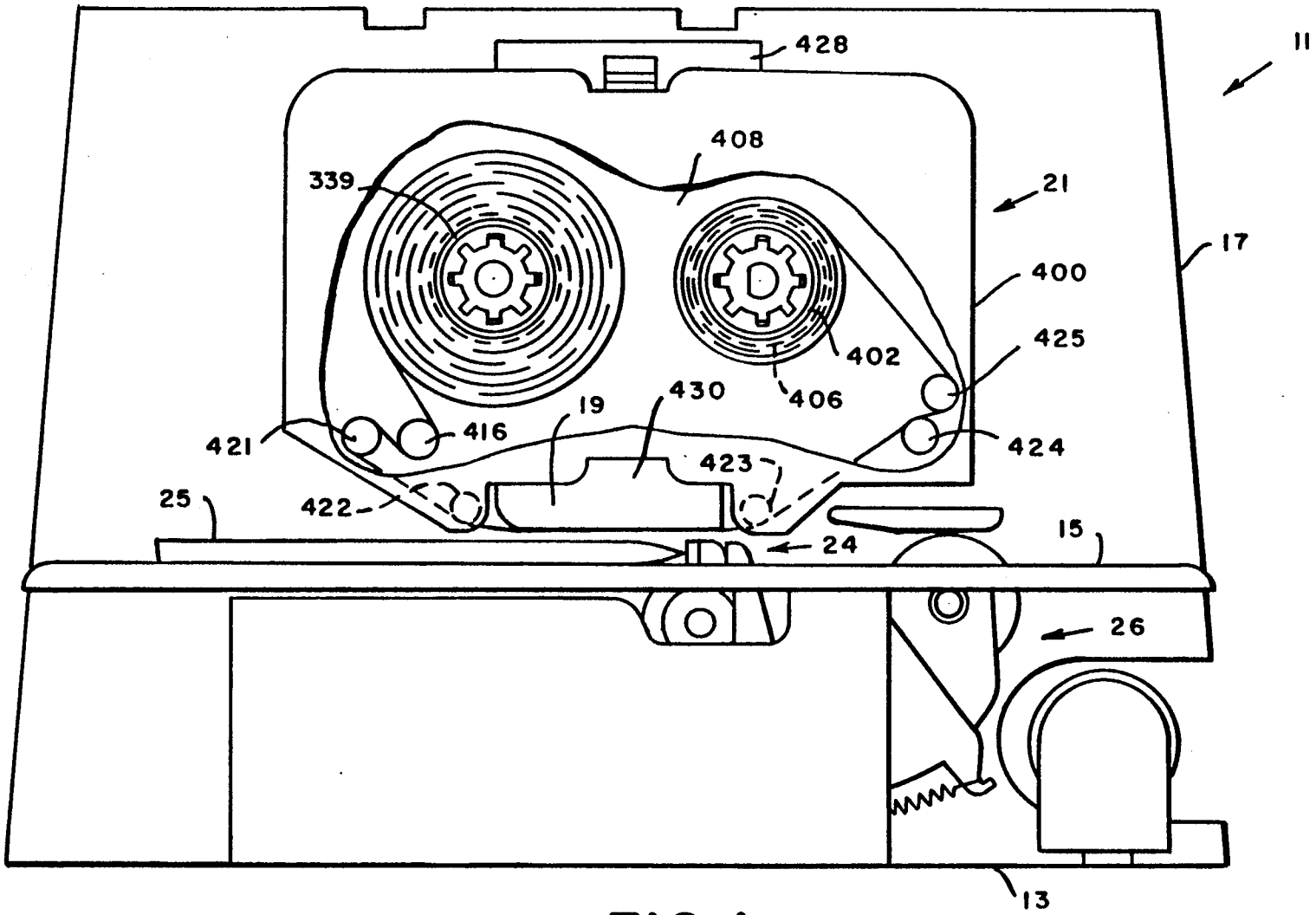
FIG. 1 is a partly section frontal view of a thermal postage meter and ribbon cassette in accordance with the present invention.

Referring to FIG. 1, a thermal postage meter, a deck 15. The base 13 supports a registration wall 17, by any conventional means, to extend vertically upward from the deck. A thermal print head 19 is fixably mounted, by any conventional means, to the rear registration wall 17. The rear registration wall 17 has mounted thereto a thermal ribbon cassette 21 of any suitable construction. Mounted in the base 13 is a position sensing arrangement, generally indicated as 24, for sensing the position of an envelope 25 positioned in the print station, generally indicated as 23. A detailed description of a preferred thermal postage meter is presented in U.S. patent application Ser. No. 07/950,341, filed concurrently herewith and commonly assigned (herein incorporated by reference).

Referring to FIGS. 2A, 2B, 2C and FIG. 5, the platen roller assembly, generally indicated as 26. The platen roller assembly 26 includes a linking arm assembly 201 comprising a first link section 203 having a receiving channel 205 and a second section link 207 having a portion matingly received in the receiving channel 205 of the first linking section 203. One end of the first linking section 203 is eccentrically mounted around the shaft 83. Shaft 83 is rotatably mounted in the bracket wall 77 and 79 of a support bracket 75 mounted to the base 13 by any suitable means. A spring 210 having its respective ends detachably mounted in the first and second sections of the linking arm 203 and 207, respectively, biases the second section 207 within the receiving channel 205 of the first link section 203. The exposed end of the second section 207 includes a hub 212. A second linking arm assembly 214 is constructed identical to the linking assembly 201 and is eccentrically mounted in cooperative and parallel alignment with the linking arm assembly 201 on the shaft 83.

A pivot link assembly, generally indicated as 218, is mounted to a shaft 216 which is rotatively mounted between the rearward and forward bracket walls 77 and 79, respectively. The pivot link assembly 218 includes a first link plate 220 pivotally mounted around shaft 216 at one point and pivotally mounted around the hub 212 at another point. A second link plate 222 is pivotally mounted around the shaft 216 at one point and includes a slot 224 wherein the hub 212 rides therein. A spring hook 223 is formed in the first link plate 220 and a spring hook 225 is formed in the second link plate 222. A spring 227 has its respective ends fastened around the respective spring hooks 223 and 225 in a conventional manner. A second pivot link assembly 226, identical to the pivot link assembly 228, is pivotally mounted to the shaft 216 in spaced apart relationship to the pivot link assembly 218. A platen module 228 is rotatively mounted by any conventional means to the link plates 220 of the respective pivot link assemblies, 218 and 226. A platen roller 230 is fixably mounted around the platen roller shaft 28, between the pivot link assemblies, 218 and 226.

A pressure roller shaft 232 is rotatively mounted by any conventional means to the link plates 222 of the respective pivot link assemblies 218 and 226. Pressure rollers 234 are fixably mounted around the pressure roller shaft 232 in spaced apart relationship. The pressure rollers 234 are aligned generally opposite a backing member fixably mounted on the registration wall 17 and extending laterally therefrom. A drive shaft 236 having a spool 238 fixably mounted to one end is responsive to the motor 44. A spool gear arrangement 240 which includes a hub 242 rotatively mounted around the shaft 216, a spool 244 fixably mounted to the hub 242 and a gear 246 also fixably mounted to the hub 242. A gear 248 is fixably mounted to the shaft 232 and a gear 250 is fixably mounted around the shaft 228. The gears 246 is constant mesh with gear 248 and 240, and an endless belt 252 extends around the spools 238 and 244.

The platen roller 230 has a length 2L and a radius of R at the center. The radius of the platen roller 230 has a linear surface transition to an end radius of (R+h). In the preferred embodiment of the present invention, the platen roller is comprised of a 25 to 35 durometer cellular urethane. The preferred dimensions.

| | |
|---|---|
| Length (2L) | 3.000 inches |
| Center Radius (R) | 0.4245 inches |
| End Radius (R + h) | 0.4845 inches |
| Taper Angle | 2.3 degrees |

An alternative platen roller 230 is comprised of sections divided into individual sections 0.010 inch slits set 0.070 inches apart and 0.10 inches deep with the same degree of taper.

Figure 2A:
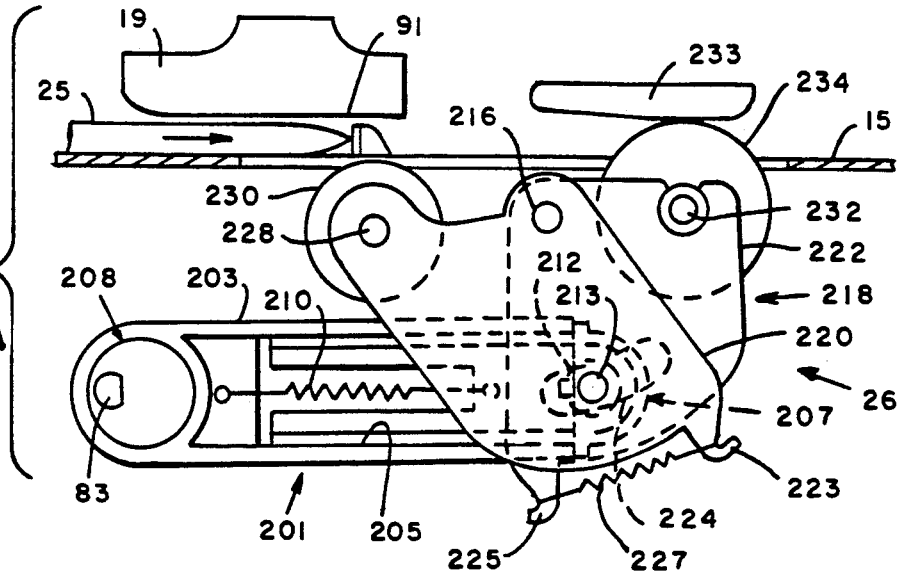
FIGS. 2A, 2B and 2C are schematic views of the platen and pressure roller assemblies in relative position during home position, print position and eject position, respectively.
Figure 2B:
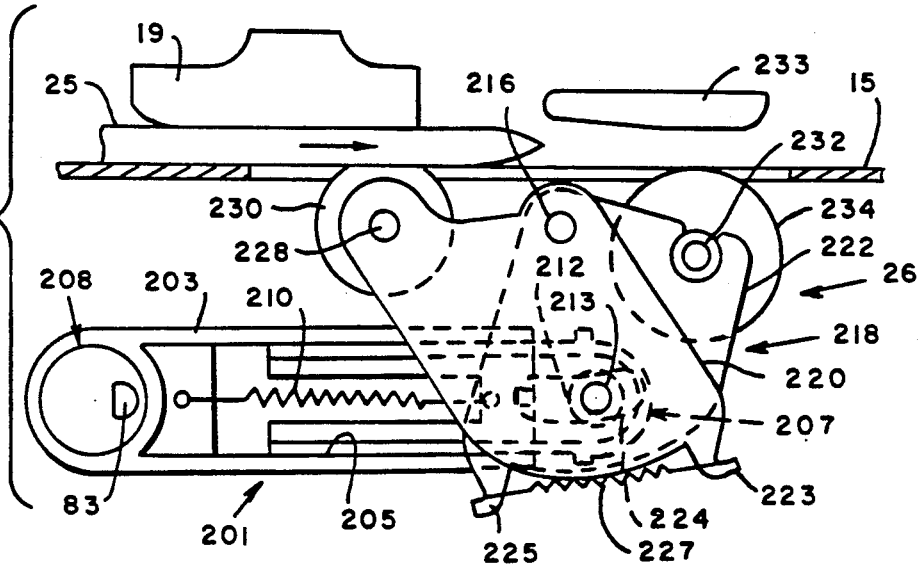
Figure 2C:
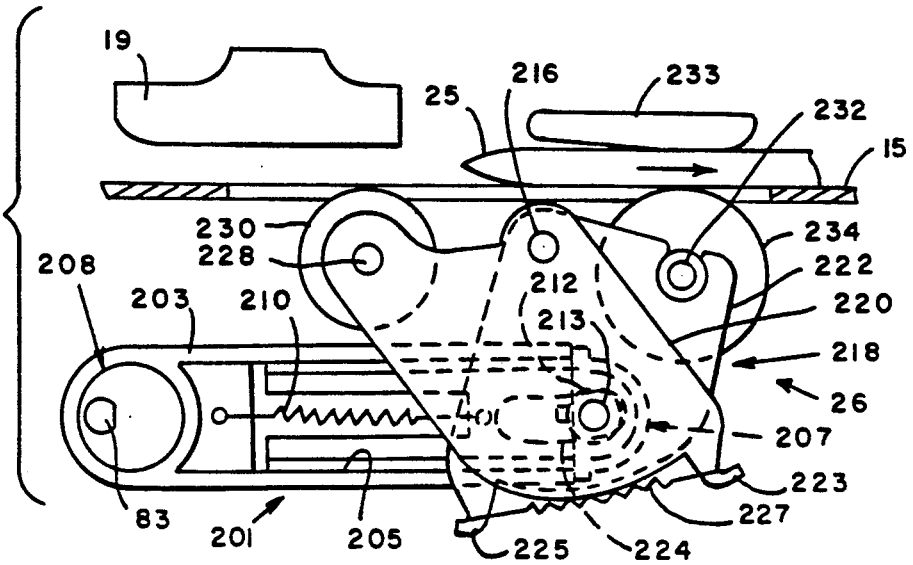
Figure 3A:
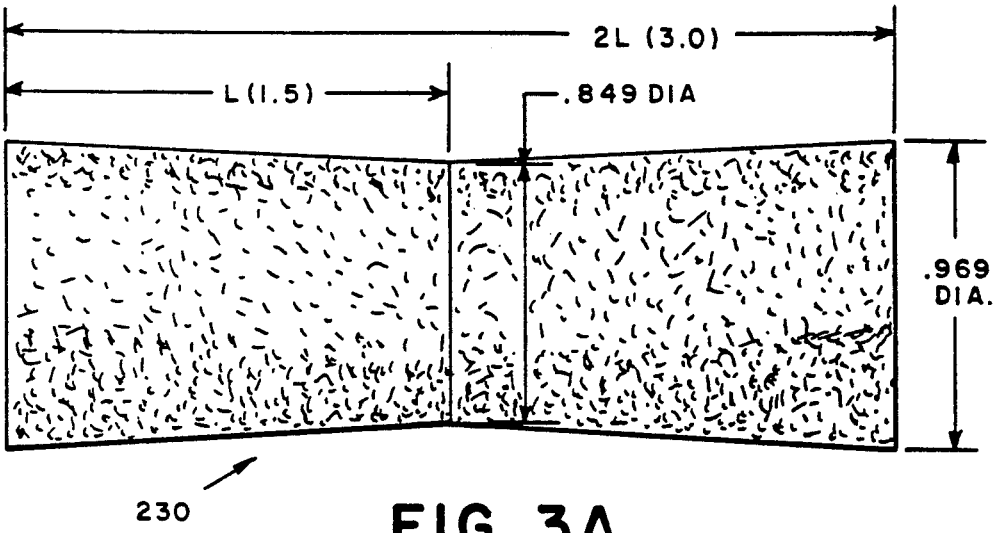
FIG. 3A is a side view of a platen roller in accordance with the present invention.
Figure 3B:
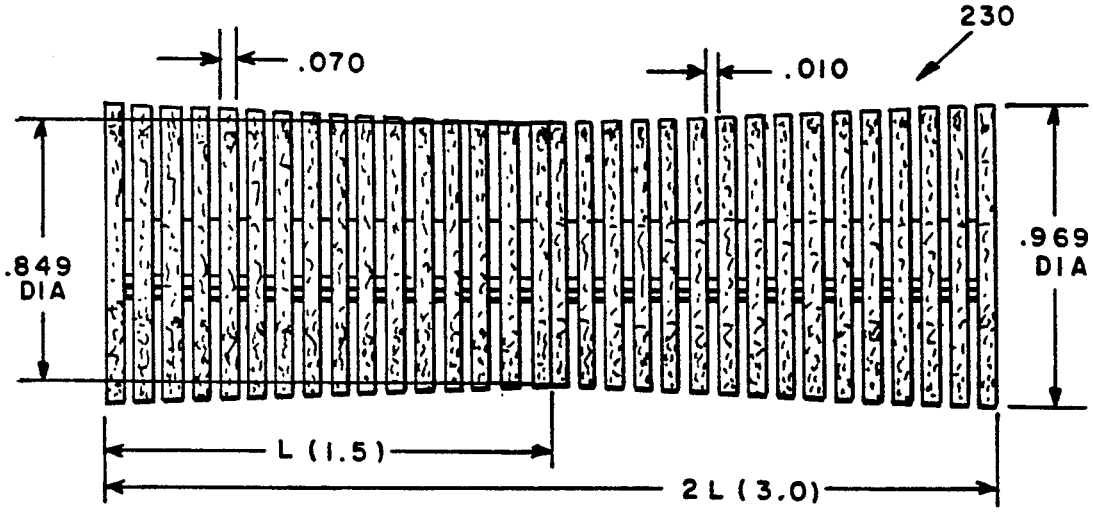
FIG. 3B is a side view of an alternative platen roller in accordance with the present invention.

Referring particularly to FIGS. 2A, 2B and 2C, the feed system consist of the platen roller 230 and ejection rollers 234. These rollers are provided with independent control of the envelope 25. They are mounted on a pivot link assembly 218 which pivots about a fixed location shaft 216. In the home position (FIG. 7A), the ejection rollers 234 are above the feed deck 15 and the platen roller 230 is below the feed deck. The shaft 83 is positioned at 0 degrees rotation.

When an envelope 25 is properly placed onto the feed deck 15 by the operator and inserted into the feed throat. The thermal printing operation is initiated by a microcontroller in any suitable manner. Upon initiation of the print cycle, the shaft 83 rotation causes the spring loaded link 201 and 214 to move the rollers 234 out of the feed path and the platen roller 230 toward the envelope 25. The platen roller 230 continues moving toward the envelope 25 until it closes the envelope 25 between the platen roller 230 and the print head 19. Depending on the mail thickness, the platen roller 230 will meet the envelope 25 at different points in the rotation of the shaft 83. The ejection rollers 234 may still be above the feed deck. The shaft 83 will then continue to rotate, causing the links 203 and 207 of link assemblies 201 and 214 to extend and both the link extension springs 210 and the ejection springs 227 to apply a load to the envelope 25. When the shaft 83 has rotated 180 degrees, the ejection roller 234 is out of the feed path, the platen roller 230 is fully engaged, and the printer has complete control of the envelope. Printing can now begin.

Once the platen roller 230 has fully engaged the envelope 25, the motor 44 is started. Note that the motor 44 turns both the platen roller 230 and the ejection rollers 234. However, the ejection roller 234 are not in the supply path so it has no affect on the envelope 25. The envelope 25 and cassette ribbon begin to feed and are brought up to speed. Printing then starts in a conventional manner by loading data to the print head at a constant rate from the microcontroller through the print head controller.

When printing has been completed, the shaft 83 rotates 180 degrees back to its original home position. The drive link 201 and 214 becomes a solid assembly which pushes the ejection roller 234 against the envelope 25. Since a lighter load is needed for ejection than for printing, the spring 227 becomes the only active spring. This 180 degree rotation engages the ejection roller and disengages the platen roller. During the rotation, the stop lever 122 and trip lever 89 are also released to extend above the feed deck. Due to their very light spring load, the lever will ride along the bottom of the envelope until it clears the platen roller.

The motor 44 continues to drive both rollers 230 and 234. At this point, however, the platen roller 230 becomes inactive because it is below the feed deck. When the ejection roller 234 engages, it feeds the envelope 25 from the printer at 2 to 3 times the print speed in the preferred. Once the envelope 25 clears the print nip, the stop and trip levers 120 and 89, respectively, return to their home position. The drive motor 44 is stopped and the process is complete.

Figure 4A:
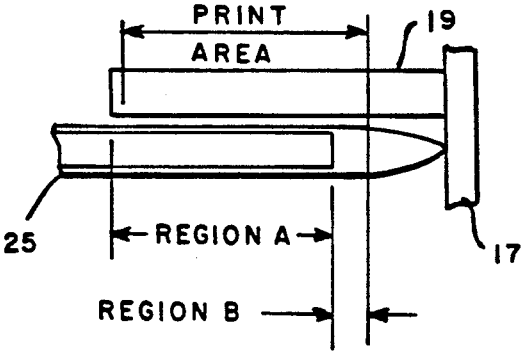
FIG. 4A is a partial side view of an envelope registration edge in the print station unloaded by the platen roller.
Figure 4B:
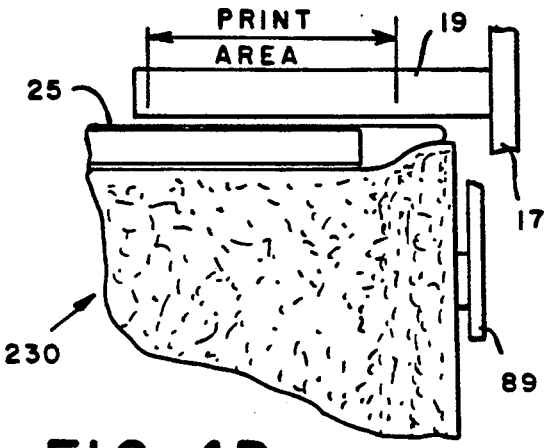
FIG. 4B is a partial side view of an envelope registration edge in the print station loaded by the platen roller in accordance with the present invention.
Figure 5:
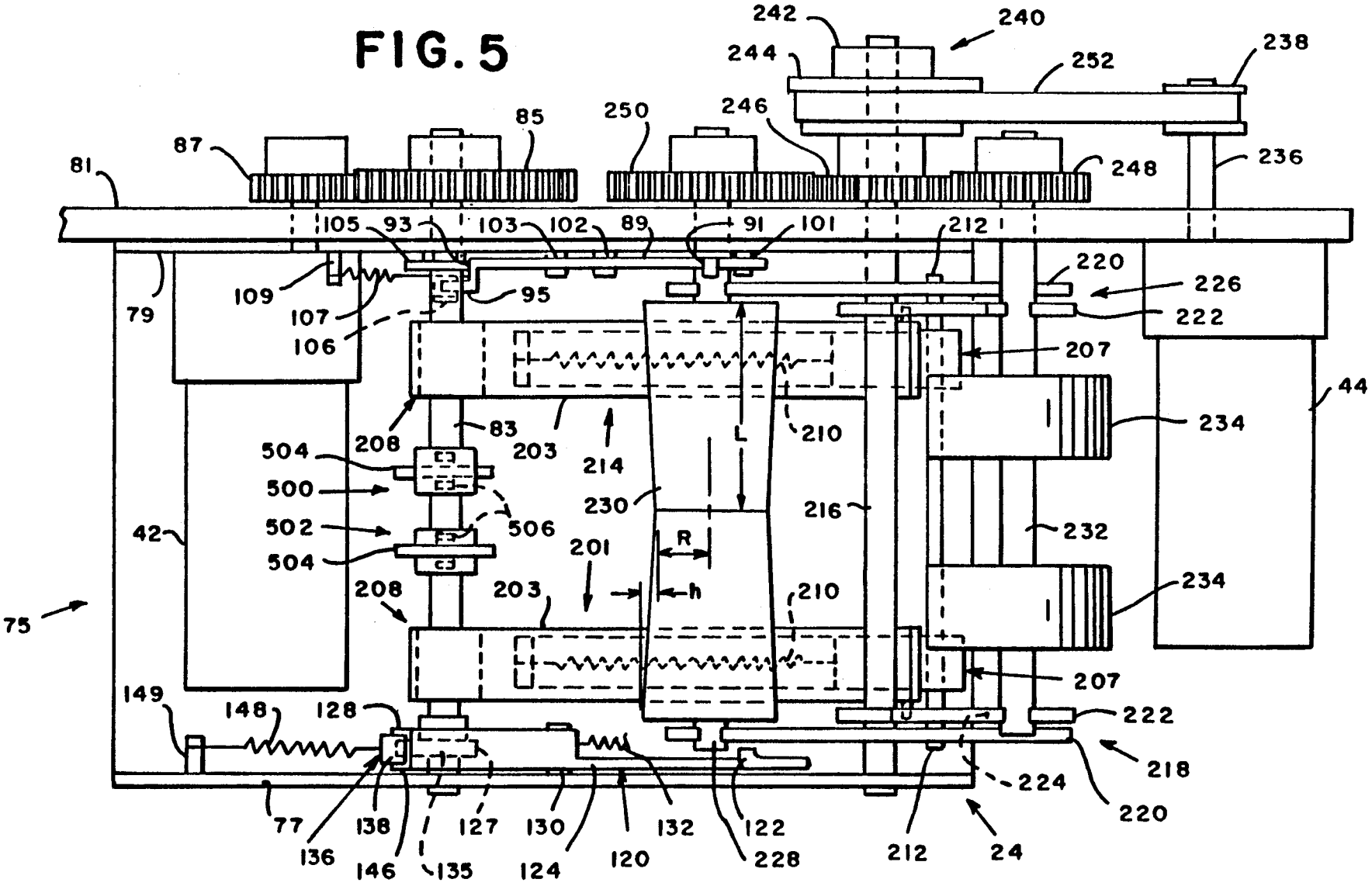
FIG. 5 is a top section view of a thermal postage meter having a platen roller in accordance with the present invention.

Referring to FIG. 4A, it is observed that because of the envelope edge contour assumed by the envelope as a result of the thickness of the envelope contents, the print region "B" is not brought into suitable engagement with the print area of the thermal print head. Referring to FIG. 4B, the presence of the platen roller of this invention as a function of its material composition and geometric shape provides increased force in region "B" such that the envelope surface force against the print head is substantially uniform.

The above description describes the preferred embodiment of the invention and should not be viewed as limiting. The scope of the invention is set forth in the appendix claims.

What is claimed is:

1. An improved platen roller for a thermal printing apparatus, the printing apparatus having a registration wall, a print deck, a thermal print head mounted to the registration wall and extending over the deck to define a print station, a platen roller support assembly for supporting the platen roller parallel to the thermal print head and causing the platen roller to bias an envelope against the thermal print head and causing the envelope to traverse the thermal print head during a print cycle of the thermal printing apparatus, the platen roller improvement comprising:

said platen roller is comprises of a 25 to 35 durometer unitary cellular urethane and having a first end section of conical configuration with an outer end of radius "R+h" and an inner end of radius "R" where "R" is less than "R+h", and having a surface taper angle "A" of between −2.0° degrees and −3.0° degrees, and having a axial length of "L" wherein $$h = L * \text{tangent}(|A|)$$

and;

axial length L is equal to or greater than 1.0 inches.

2. The improved platen roller as claimed in claim 1 wherein the platen roller is symmetric about the inner end.

3. The improved platen roller as claimed in claim 1 wherein the thermal printing apparatus is a thermal printing postage meter.

4. The improved platen roller as claimed in claim 1 wherein the platen roller has a second end section of conical configuration with an outer end of "R+h" and an inner end of radius "R" where "R" is less than "R+h", and having a surface taper angle "A" of between −2.0° degrees and −3.0° degrees, and having a axial length of "L" wherein $$h = L * \text{tangent}(|A|)$$

and;

axial length "L" is equal to or greater than 1.0 inches.

5. The improved platen roller as claimed in claim 4 wherein: "L" equals 1.5 inches; "R" equals 0.4245 inches; "R+h" equals 0.4845 inches and "A" equals 2.3 degrees.

6. The improved platen roller as claimed in claim 4 wherein the thermal printing apparatus is a thermal printing postage meter.

7. An improved platen roller for a thermal printing apparatus, the printing apparatus having a registration wall, a print deck, a thermal print head mounted to the registration wall and extending over the deck to define a print station, a platen roller support assembly for supporting the platen roller parallel to the thermal print head and causing the platen roller to bias an envelope against the thermal print head and causing the envelope to traverse the thermal print head during a print cycle of the thermal printing apparatus, the platen roller improvement comprising:

said platen roller being segmented into a plurality of equal axial segments "N" of between 25 to 35 durometer cellular urethane, each of said segments segment having a segment thickness "$X_s$" between 0.06 and 1.5 inches and a gap distance "Z" of between 0.005 and 0.75 inches having a first end section of conical configuration with an outer end of "R+h" and an inner end of radius "R" where "R" is less than "R+h", and having a surface taper angle "A" of between −2.0° degrees and −3.0° degrees, and having a axial length of "L" wherein:

$$h = L * \text{tangent}(|A|)$$

and;

axial length L is equal to or greater than 1.0 inches.

8. The improved platen roller as claimed in claim 7 wherein the platen roller has a second end section of conical configuration with an outer end of "R+h" and an inner end of radius "R" where "R" is less than "R+h", and having a surface taper angle "A" of between −2.0° degrees and −3.0° degrees, and having a axial length of "L" wherein $$h = L * \text{tangent}(|A|)$$

and;

axial length "L" is equal to or greater than 1.0 inches.

* * * * *